US011258208B2

(12) United States Patent
Bischoff et al.

(10) Patent No.: US 11,258,208 B2
(45) Date of Patent: Feb. 22, 2022

(54) MODULE FOR A HIGH-CURRENT PLUG AND/OR A HIGH-CURRENT CABLE, HIGH-CURRENT PLUG, AND METHOD OF INFLUENCING THE EMC BEHAVIOUR

(71) Applicant: TE Connectivity Germany GmbH, Bensheim (DE)

(72) Inventors: Daniel Bischoff, Buettelborn (DE); Jens Koester, Rossdorf (DE); Mohammad Nikfal, Darmstadt (DE)

(73) Assignee: TE CONNECTIVITY GERMANY GMBH, Bensheim (DE)

( * ) Notice: Subject to any disclaimer, the term of this patent is extended or adjusted under 35 U.S.C. 154(b) by 0 days.

(21) Appl. No.: 16/794,890

(22) Filed: Feb. 19, 2020

(65) Prior Publication Data

US 2020/0185864 A1 Jun. 11, 2020

Related U.S. Application Data

(63) Continuation of application No. PCT/EP2018/079472, filed on Oct. 26, 2018.

(30) Foreign Application Priority Data

Nov. 2, 2017 (DE) ..... 102017219493.6

(51) Int. Cl.
*H01R 13/659* (2011.01)
*H01R 13/6592* (2011.01)
*H01R 13/6464* (2011.01)

(52) U.S. Cl.
CPC ..... *H01R 13/6592* (2013.01); *H01R 13/6464* (2013.01)

(58) Field of Classification Search
CPC ..... H01R 13/6592; H01R 13/6464
USPC ..... 439/607
See application file for complete search history.

(56) References Cited

U.S. PATENT DOCUMENTS

| | | | | |
|---|---|---|---|---|
| 7,108,552 | B2 * | 9/2006 | Niitsu | H01R 12/725 439/607.35 |
| 8,480,421 | B2 * | 7/2013 | Yoshioka | H01R 43/24 439/275 |
| 8,540,527 | B2 * | 9/2013 | Puluc | H01R 13/64 439/271 |
| 8,672,711 | B2 * | 3/2014 | Kondo | H01R 12/57 439/607.4 |
| 8,777,643 | B2 * | 7/2014 | De France | H01R 4/46 439/99 |
| 8,932,079 | B2 * | 1/2015 | Marsh | H01R 9/0503 439/585 |
| 9,196,976 | B2 * | 11/2015 | De France | H01R 9/0521 |

(Continued)

FOREIGN PATENT DOCUMENTS

| | | |
|---|---|---|
| CN | 107005210 A | 8/2017 |
| DE | 8810281 U1 | 12/1989 |
| WO | 9405092 A1 | 3/1994 |

OTHER PUBLICATIONS

PCT Written Opinion and International Search Report, App No. PCT/EP2018/079472, dated Jan. 14, 2019, 13 pages.

(Continued)

*Primary Examiner* — Alexander Gilman

(57) ABSTRACT

A module for a high-current plug and/or a high-current cable includes a coupling face coupling to a shield and an influencing device influencing an electromagnetic property of the shield.

14 Claims, 3 Drawing Sheets

(56) References Cited

U.S. PATENT DOCUMENTS

| | | | | |
|---|---|---|---|---|
| 9,515,422 | B2 * | 12/2016 | Karrasch | H01R 13/658 |
| 10,637,197 | B2 * | 4/2020 | Oka | H01R 13/6598 |
| 10,897,105 | B2 * | 1/2021 | Iizuka | H01R 13/533 |
| 11,022,219 | B2 * | 6/2021 | Hensel | H01R 4/48 |
| 2009/0023336 | A1 * | 1/2009 | Kondo | H01R 13/6473 439/607.01 |
| 2013/0175080 | A1 * | 7/2013 | Colahan | H01R 13/6658 174/357 |
| 2015/0044909 | A1 * | 2/2015 | Dunwoody | H05K 9/0018 439/607.56 |
| 2015/0270649 | A1 * | 9/2015 | Blazek | H01R 13/6599 439/607.02 |
| 2015/0289420 | A1 * | 10/2015 | Imahori | H05K 9/0098 174/350 |
| 2016/0352047 | A1 * | 12/2016 | Xing | H01R 13/6591 |
| 2017/0194929 | A1 * | 7/2017 | Kochetov | B60R 16/0215 |
| 2017/0263350 | A1 * | 9/2017 | Oka | B60R 16/0215 |
| 2020/0127422 | A1 * | 4/2020 | Biddle | H05K 9/0016 |

OTHER PUBLICATIONS

First Office Action from the CNIPA, dated Dec. 25, 2020, in Appln No. 201880070373.2 and English translation thereof; 25 pp.
Abstract of CN107005210, published Aug. 1, 2017, 2pp.
Abstract of EP0355276A1, published Feb. 28, 1990, 1p.

* cited by examiner

MODULE FOR A HIGH-CURRENT PLUG AND/OR A HIGH-CURRENT CABLE, HIGH-CURRENT PLUG, AND METHOD OF INFLUENCING THE EMC BEHAVIOUR

CROSS-REFERENCE TO RELATED APPLICATIONS

This application is a continuation of PCT International Application No. PCT/EP2018/079472, filed on Oct. 26, 2018, which claims priority under 35 U.S.C. § 119 to German Patent Application No. 102017219493.6, filed on Nov. 2, 2017.

FIELD OF THE INVENTION

The present invention relates to a module and, more particularly, to a module for a high-current plug.

BACKGROUND

In the case of high currents, especially when alternating currents or pulsed currents are involved, currents can occur even in a shield of shielded cables such as coaxial cables. These currents lead to an electromagnetic field outside the cable and thereby cause disturbances at other components.

A previous method for controlling frequency and power is the PWD-VFD (Pulse Width Modulation—Variable Frequency Drive). Here an alternating current is generated by switching a direct current successively in alternating directions. The switching produces significant quantities of common mode noise (CMN), which has to be taken up by the power and grounding systems and dissipated (>1 MHz). To prevent these stray currents from damaging or disrupting the system components, the grounding system must provide a path with low impedance for the currents of the CMN. At the same time, shield currents with low frequencies (<1 KHz) should be reduced in the shielded cables on account of the heat build-up in the plug.

SUMMARY

A module for a high-current plug and/or a high-current cable includes a coupling face coupling to a shield and an influencing device influencing an electromagnetic property of the shield.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
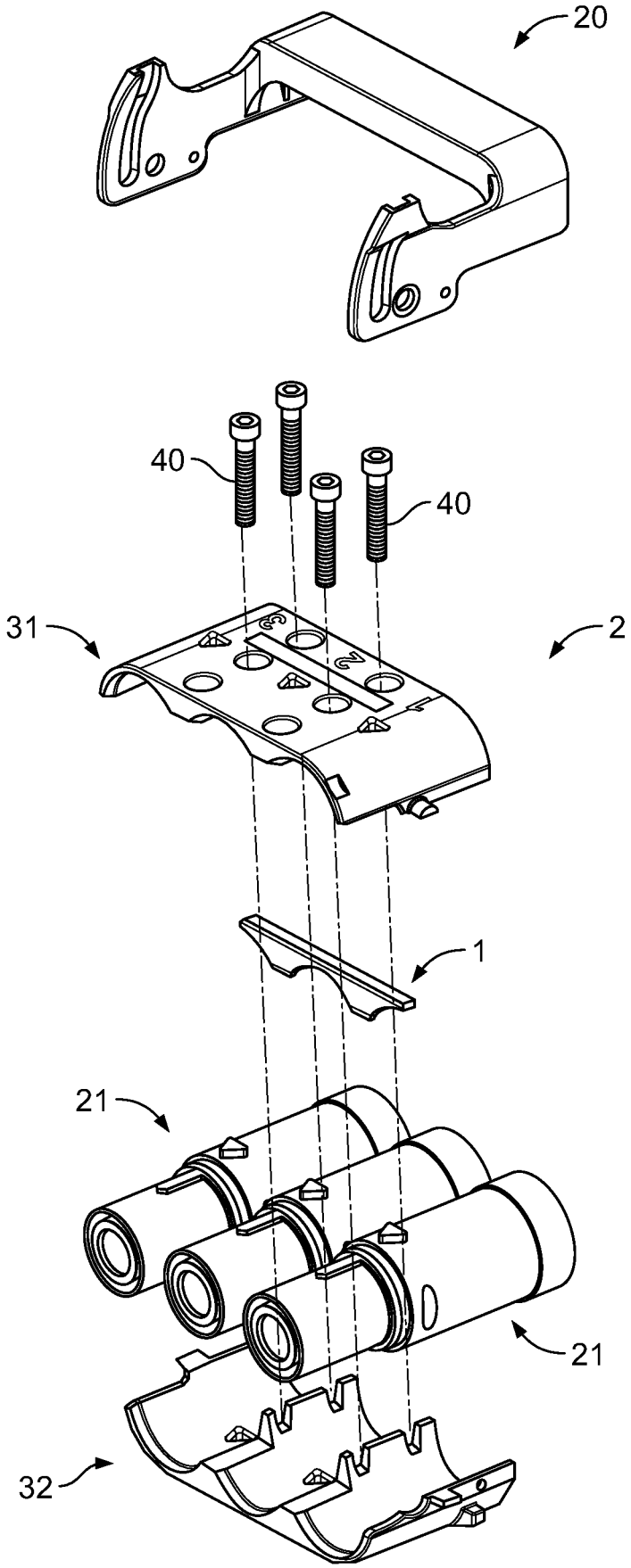
FIG. 1 is an exploded perspective view of a high-current plug according to an embodiment.

The present disclosure will be described hereinafter in further detail with reference to the following embodiments, taken in conjunction with the accompanying drawings. In the specification, the same or similar reference numerals indicate the same or similar parts. The description of the embodiments of the present disclosure hereinafter with reference to the accompanying drawings is intended to explain the general inventive concept of the present disclosure, and should not be constructed as a limitation to the present disclosure. The embodiments and configurations depicted here are each independent of one another and can be combined with one another in any way, according to necessity in a particular application.

A high-current plug 2 according to an embodiment is shown in FIG. 1. The high-current plug 2 has a plurality of sleeves 21, three in the shown embodiment, which are used for the different phases of a three-phase current. The sleeves 21 are arranged between an upper shell 31 and a lower shell 32 of the plug 2, which are attached to one another by a plurality of screws 40.

The high-current plug 2, as shown in FIG. 1, includes a lever 20. The high-current plug 2 can be pressed onto a mating plug with the lever 20.

Figure 2:
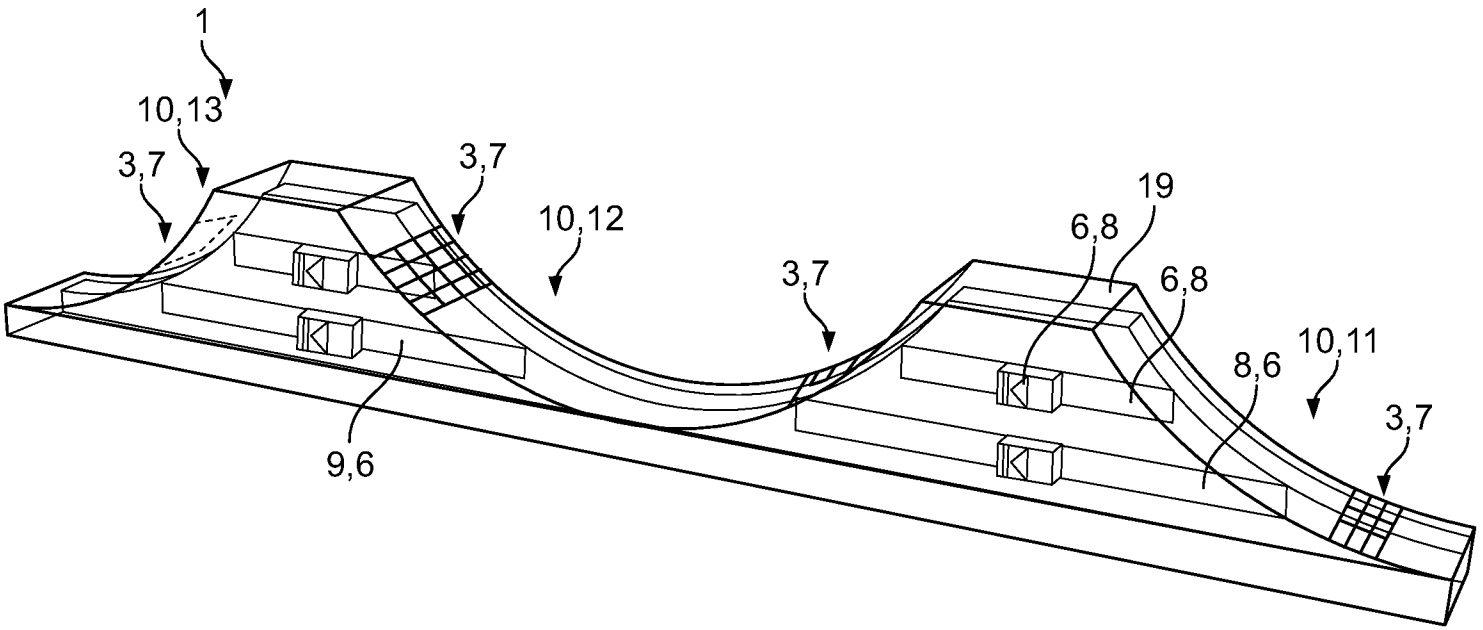
FIG. 2 is a perspective view of a module of the high-current plug.

The high current plug 2 includes a module 1, shown in FIGS. 1 and 2, arranged between the upper shell 31 and the sleeves 21. The module 1 is used to influence the electromagnetic properties of a shield 4 of a connected high-current cable 5, shown in FIG. 3, in a desired manner. By the use of the module 1, currents flowing in the shield 4 can be altered in such a way that, for example, an electromagnetic field generated by the current of the shield 4 is below permissible values and does not disturb any adjacent components or mechanisms. In an embodiment, the module 1 is a passive filter, which reduces a current in an undesirable frequency range.

In an embodiment, the high-current plug 2 has a receptacle for the module 1. The module 1 can be configured complementarily to the receptacle.

As shown in FIG. 2, the module 1 has a plurality of coupling faces 3, which are contact faces 7 at which electrical contact takes place. The module 1 has a plurality of influencing devices 6, which influence the electrical properties of a coupled shield 4 in a desired manner. The influencing devices 6 can be electrical structural components 8, such as, for instance, inductors 62, capacitors 63, resistors 65 or similar, as shown in FIG. 3.

In an embodiment, the influencing device 6 can be formed, for example, by a metal plate 9 and/or comprise such a metal plate 9 as shown in FIG. 2. The metal plate 9 can be configured in such a way that it produces a desired influencing of the shield current. The size and shape that such a metal plate 9 must have in order to achieve a desired influencing can be calculated by a simulation, for example.

In an embodiment, whether the influencing device 6 is an electrical structural component 8 or a metal plate 9 is selected according to an electromagnetic behavior to influence the shield 4; the influencing device 6 can be chosen based on application and optimized for the application.

Figure 3:
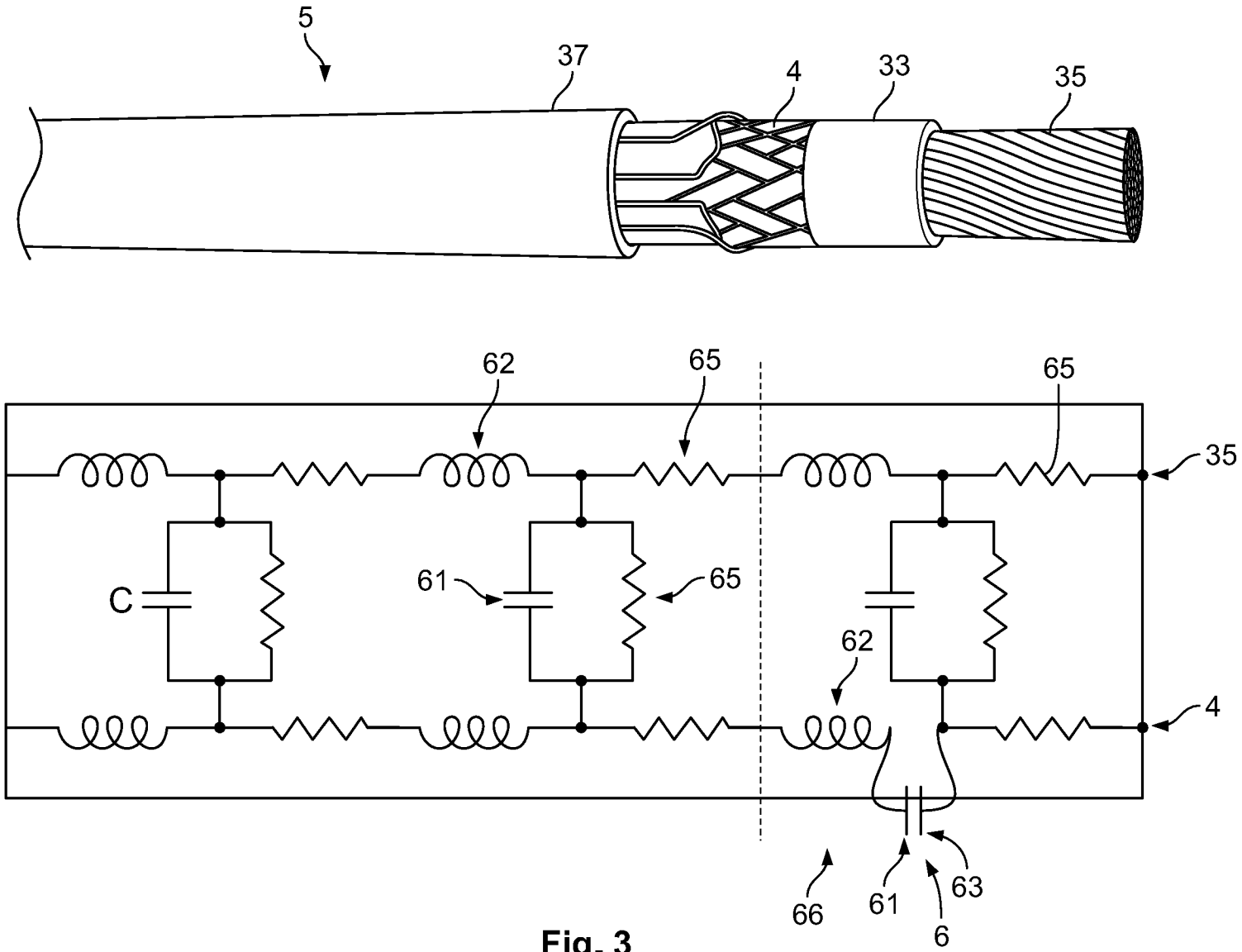
FIG. 3 is a perspective view of a high-current cable and a schematic electric circuit according to an embodiment.

If several elements are present in the influencing device 6, these can form an electric circuit 66 shown in FIG. 3. The influencing device 6 can be tunable, for example by tunable elements such as adjustable resistors 65, inductors 62 or capacitors 63 shown in FIG. 3. The influencing device 6 can thereby be used in various applications. Furthermore, various components can be exchangeable.

As shown in FIG. 2, the module 1 has a plurality of curves 10, which are adapted to the circular cross section of the high-current cable 5 and the sleeves 21. The coupling faces 3 lie respectively on the inside of the curves 10. In the embodiment shown, three curves 10 are present. A first curve 10, 11 and a third curve 10, 13 lie on the outside of module 1 and are roughly half as wide as a second curve 10, 12, which lies in a center between the first curve 10, 11 and the third curve 10, 13. Two influencing devices 6 present each extend from the first curve 10, 11 to the adjacent second curve 10, 12. They are each arranged between two curves 10. They can be configured, for example, in such a way that a single influencing device 6 can be used for two shields 4.

The module 1, as shown in FIG. 2, has an injection-molded element 19, in which the influencing devices 6 are embedded. The module 1 is thereby stable and the influencing device 6 is protected against water and dust.

The high-current cable 5 and an equivalent circuit diagram are shown in FIG. 3. The high-current cable 5 has an inner conductor 35, an inner insulation 33 arranged over the inner conductor 35, which is enclosed in turn by the shield 4 and an external insulation 37. The high-current cable 5 has capacitances 61, inductances 62 and resistances 65, which are depicted in the equivalent circuit diagram.

The coupling faces 3, or contact faces 7, are coupled to and electrically contact the shield 4, the curves 10 permit a simple connection between the contact face 7 and the shield 4. The contact faces 7 are positioned externally and on a side of the module 1 facing the shield 4. The module 1 is thereby fitted on the high-current plug 2 and/or the high-current cable 5. In an embodiment, the high-current plug 2 has a pressing mechanism pressing the module 1 onto the shield 4. In another embodiment, a contactless coupling can take place, for example inductively or capacitively.

Due to the coupling of the influencing device 6, which can add a further capacitance 61 in the form of a capacitor 63, the electromagnetic properties and electromagnetic compatibility (EMC) of the shield 4 and the high-current cable 5 can be influenced positively. The influencing device 6 can be configured to influence the radiation properties of the shield 4 in order to prevent a disruption of adjacent mechanisms. To facilitate adaptation to different high-current mechanisms, at least a part of the influencing device 6 can be exchangeable. For example, electrical components 8 such as resistors 65, coils, or capacitors 63 can be exchangeable. The shield 4 current and/or a radiation behavior of the high-current cable 5, such as a coaxial cable, and high-current plugs can then be improved and/or controlled.

In another embodiment, the module 1 can also be used outside of the high-current plug 2; the module 1 can be used on a cable harness.

What is claimed is:

1. A module for a high-current plug and/or a high-current cable, comprising:

a coupling face coupling to a shield, the coupling face is a contact face electrically contacting the shield;

an injection-molded element having a first curve and a second curve opening in a same direction, the coupling face is disposed on at least one of the first curve and the second curve; and an influencing device influencing an electromagnetic property of the shield, the influencing device is embedded in the injection-molded element between the first curve and the second curve.

2. The module of claim 1, wherein the influencing device is a resistor, an inductor, and/or a capacitor.

3. The module of claim 1, wherein the influencing device is a metal plate.

4. The module of claim 1, wherein the influencing device influences a radiation property of the shield.

5. The module of claim 1, wherein at least a part of the influencing device is exchangeable.

6. The module of claim 1, wherein the influencing device is tunable.

7. The module of claim 1, wherein the first curve or the second curve contacts the shield.

8. The module of claim 1, wherein the influencing device extends from the first curve to the second curve.

9. The module of claim 1, wherein the influencing device is entirely embedded in the injection-molded element.

10. The module of claim 1, wherein the injection-molded element has a third curve opening in the same direction as the first curve and the second curve.

11. The module of claim 10, wherein the first curve and the third curve lie on an outside of the injection-molded element and are approximately half as wide as the second curve, the second curve is disposed between the first curve and the third curve.

12. A high-current plug, comprising:

an upper shell;

a lower shell;

a plurality of sleeves arranged between the upper shell and the lower shell; and a module arranged between the upper shell and the sleeves, the module including a coupling face coupling to a shield, the coupling face is a contact face electrically contacting the shield, an injection-molded element on which the coupling face is disposed, and an influencing device influencing an electromagnetic property of the shield, the influencing device is embedded in the injection-molded element.

13. The high-current plug of claim 12, further comprising a high-current cable having an external insulation, an inner insulation, the shield arranged between the external insulation and the inner insulation, and an inner conductor arranged within the inner insulation.

14. A method for influencing an electromagnetic compatibility of a high-current cable, comprising:

fitting a module influencing a shield current of a shield to the high-current cable, the module has a coupling face coupling to the shield, the coupling face is a contact face electrically contacting the shield, an injection molded element on which the coupling face is disposed, and an influencing device influencing the shield current, the influencing device is embedded in the injection-molded element, the module is pressed onto the shield of the high-current cable.

* * * * *